US010188572B2

(12) United States Patent
Bochner et al.

(10) Patent No.: US 10,188,572 B2
(45) Date of Patent: Jan. 29, 2019

(54) STIRRUPS DEVICES

(71) Applicants: Ronnie Z. Bochner, New York, NY (US); Greene Donald Royster, IV, San Antonio, TX (US)

(72) Inventors: Ronnie Z. Bochner, New York, NY (US); Greene Donald Royster, IV, San Antonio, TX (US)

(73) Assignee: Rapid Deployment Stirrups, LLC, Wilmington, DE (US)

( * ) Notice: Subject to any disclaimer, the term of this patent is extended or adjusted under 35 U.S.C. 154(b) by 668 days.

(21) Appl. No.: 14/799,187

(22) Filed: Jul. 14, 2015

(65) Prior Publication Data

US 2017/0014292 A1 Jan. 19, 2017

(51) Int. Cl.
*A61G 13/12* (2006.01)
*A61G 1/04* (2006.01)

(52) U.S. Cl.
CPC ..... *A61G 13/125* (2013.01); *A61G 1/04* (2013.01)

(58) Field of Classification Search
CPC ..... A61G 13/125; A61G 1/00; A61G 1/04; A61G 1/013
See application file for complete search history.

(56) References Cited

U.S. PATENT DOCUMENTS 2,067,891 A * 1/1937 Comper ..... A61G 13/12 27/21.1
2,792,266 A 5/1957 Waters
3,104,446 A * 9/1963 Throop, Jr. ..... A61G 17/04 27/21.1
3,516,652 A * 6/1970 Roblee ..... A61G 13/12 5/650
3,907,270 A * 9/1975 Ezzo ..... A61G 13/0009 297/423.4
3,982,742 A * 9/1976 Ford ..... A61G 13/12 5/624
4,426,071 A * 1/1984 Klevstad ..... A61G 13/12 5/602

(Continued)

OTHER PUBLICATIONS

"Greene Stirrups", product developed by G. Donald Royster and Ronnie Z. Bochner; Prototype presented at 2011 Annual District Meeting, Armed Forces District, American Congress of Obstetricians and Gynecologists, Oct. 23, 2011; 3 pages.

*Primary Examiner* — Eric J Kurilla
(74) *Attorney, Agent, or Firm* — Greenberg Traurig, LLP

(57) ABSTRACT

A stirrups device includes a transverse member having a first end, a second end, and a horizontal axis. The device also includes first and second connectors fastened to corresponding first and second ends of the transverse member. Each of the connectors has a bracket and a hinge affixed thereto. The device also includes first and second stirrups assemblies pivotally attached to the corresponding first and second hinges. Each of the stirrups assemblies includes a stanchion having a first end and, a second end, and a longitudinal axis. The first end is pivotally affixed to the hinge. The longitudinal axis can be selectively oriented to be substantially parallel to the horizontal axis, along a vertical axis, and along a normal axis. Each of the stirrups assemblies also includes a stirrup support telescopically extensible from the second end of the stanchion, and a multi-positional foot support stirrup slideably positioned along the stanchion.

16 Claims, 17 Drawing Sheets

(56) References Cited

U.S. PATENT DOCUMENTS 4,809,687 A * 3/1989 Allen ..... A61G 13/12 5/624
5,226,187 A 7/1993 Borders et al.
5,713,591 A 2/1998 Zarkhin et al.
5,718,011 A * 2/1998 Nogues ..... A47D 5/00 5/603
6,108,841 A * 8/2000 Cameron ..... A61G 13/0009 5/624
6,698,044 B2 * 3/2004 Greenfield ..... A61F 5/3776 248/104
6,907,632 B2 * 6/2005 Bourgraf, Jr. ..... A61G 1/013 16/340
7,243,654 B2 7/2007 Schuerch
7,367,578 B2 5/2008 Jansen
7,461,857 B2 12/2008 Darling, III
8,875,327 B2 11/2014 Gilley et al.
2003/0182726 A1 * 10/2003 Greenfield ..... A61F 5/3776 5/648
2009/0235457 A1 9/2009 Harvey
2010/0242181 A1 * 9/2010 Bochner ..... A61G 7/075 5/649
2011/0015552 A1 * 1/2011 Rohde ..... A61B 17/42 601/45
2013/0318717 A1 12/2013 Iheoma
2014/0068866 A1 * 3/2014 Catacchio ..... A61G 13/0036 5/630
2014/0261099 A1 * 9/2014 Lewis ..... A61G 13/101 108/49
2016/0022515 A1 * 1/2016 MacDonald ..... A61G 1/04 5/625
2016/0287461 A1 * 10/2016 Naughton ..... A61G 13/04
2016/0302987 A1 * 10/2016 Bochner ..... A61G 13/1245
2017/0014292 A1 * 1/2017 Bochner ..... A61G 13/125
2017/0239118 A1 * 8/2017 Cole ..... A61G 13/101
2017/0246059 A1 * 8/2017 Chinn ..... A47C 19/02

* cited by examiner

STIRRUPS DEVICES

TECHNICAL FIELD OF THE INVENTION

The exemplary embodiments relate to medical examination devices and, more particularly, to a collapsible foot and leg stirrups assembly for facilitating a medical examination.

BACKGROUND

Medical practitioners regularly utilize stationary medical examination tables especially adapted to support the feet and legs of a patient to facilitate a medical examination (e.g., a gynecological examination). Moveable bedside medical examination tables have been developed for facilitating medical examinations of patients that may be bed-bound or are unable to position themselves on stationary medical examination tables. However, such moveable tables are often expensive, and are typically not portable outside a medical facility (e.g., a hospital). Therefore, an inexpensive, portable medical examination device providing support for the feet and legs of a patient who is recumbent on a stretcher or bed outside a medical facility (e.g., a battlefield or other military setting) is desirable.

SUMMARY OF THE INVENTION

In an embodiment, a device for facilitating a medical examination includes a transverse member having a first end, a second end opposite said first end, and a horizontal axis extending from the first end to the second end. The device also includes first and second connectors fastened to corresponding ones of the first and second ends of the transverse member. Each of the first and second connectors has a bracket and a hinge affixed thereto. The device also includes first and second stirrups assemblies pivotally attached to corresponding first and second ones of the hinges. Each of the stirrups assemblies includes a stanchion having a first end, a second end opposite the first end, and a longitudinal axis extending from the first end to the second end. The first end is pivotally affixed to the hinge such that the longitudinal axis of the stanchion can be selectively oriented in (i) a first orientation substantially parallel to the horizontal axis of said transverse member, (ii) a second orientation along a vertical axis substantially perpendicular to the horizontal axis of the transverse member, and (iii) a third orientation along a normal axis substantially perpendicular to the horizontal axis of the transverse member and substantially perpendicular to the vertical axis. Each of the stirrups assemblies also includes a stirrup support telescopically extensible from the second end of the stanchion along the longitudinal axis of the stanchion. Each of the stirrups assemblies also includes a multi-positional foot support stirrup slideably positioned along the stanchion.

In an embodiment, the stirrup support includes a first portion that is substantially parallel to the longitudinal axis of the stanchion and a second portion that is substantially perpendicular to the longitudinal axis of the stanchion. In an embodiment, the stirrup support includes a curved portion connecting the first portion to the second portion. In an embodiment, the stirrup support includes an eye fixed to the second portion. In an embodiment, the stirrup support includes a chain link removably engaged with the eye. In an embodiment, the stirrup support includes a soft stirrup removably engaged with the chain link.

In an embodiment, the stirrups assembly also includes means for securing the stirrup support at a desired extension from the second end of the stanchion. In an embodiment, the means for securing the stirrup support includes a pin adjacent the second end of the stanchion and a plurality of holes within the stirrup support. Each of the holes is adapted to selectively receive the pin. In an embodiment, the multi-positional foot support stirrup includes a mounting bracket. In an embodiment, the mounting bracket is operable to retain the multi-positional foot support stirrup in a position along the stanchion.

In an embodiment, the bracket is adapted to engage a pole of a stretcher. In an embodiment, the bracket includes a barrier sized and shaped to be complementary to the pole of the stretcher. In an embodiment, the barrier includes nylon. In an embodiment, the transverse member is U-shaped. In an embodiment, the transverse member includes a central portion disposed between the first end and the second end. The central portion has a longitudinal axis that is substantially parallel to the horizontal axis and offset from the horizontal axis. In an embodiment, each of the connectors includes a plate.

In an embodiment, a method relates to examining a patient on a stretcher. The patient has a first foot and a second foot. The stretcher has a first pole and a second pole. The method includes providing an examination device. The examination device includes a transverse member having a first end, a second end opposite the first end, and a horizontal axis extending from the first end to the second end. The examination device also includes first and second connectors fastened to corresponding ones of the first and second ends of the transverse member. Each of the first and second connectors has a bracket and a hinge affixed thereto. The examination device also includes first and second stirrups assemblies pivotally attached to corresponding first and second ones of the hinges. Each of the stirrups assemblies includes a stanchion having a first end, a second end opposite the first end, and a longitudinal axis extending from the first end to said second end. The first end is pivotally affixed to the hinge such that the longitudinal axis of the stanchion can be selectively oriented in (i) a first orientation substantially parallel to the horizontal axis of the transverse member, (ii) a second orientation along a vertical axis substantially perpendicular to the horizontal axis of the transverse member, and (iii) a third orientation along a normal axis substantially perpendicular to the horizontal axis of the transverse member and substantially perpendicular to the vertical axis. Each of the stirrups assemblies also includes a stirrup support telescopically extensible from the second end of the stanchion along the longitudinal axis of the stanchion. Each of the stirrups assemblies also includes a multi-positional foot support stirrup slideably positioned along the stanchion. The method also includes attaching the examination device to the stretcher by inserting the first and second poles of the stretcher into corresponding ones of the brackets affixed to the first and second connectors. The method also includes positioning the stanchions of the first and second stirrups assemblies in a selected one of the second and third orientations. The method also includes positioning a selected one of (i) the stirrup supports of the first and second stirrups assemblies and (ii) the multi-positional foot support stirrups of the first and second stirrups assemblies in a selected position. The method also includes placing the first foot of the patient in the selected one of (i) the stirrup support of the first stirrups assembly and (ii) the multi-positional foot support stirrup of said first stirrups assembly. The method also includes placing the second foot of the patient in the selected one of (i) the stirrup support of the second stirrups assembly and (ii) the multi-positional foot support stirrup of the second stirrups assembly. The method also includes examining the patient.

BRIEF DESCRIPTION OF THE DRAWINGS

For a more complete understanding of the present invention, reference is made to the following detailed description of an exemplary embodiment of the present invention considered in conjunction with the accompanying drawings, in which.

DETAILED DESCRIPTION OF THE INVENTION

Figure 1:
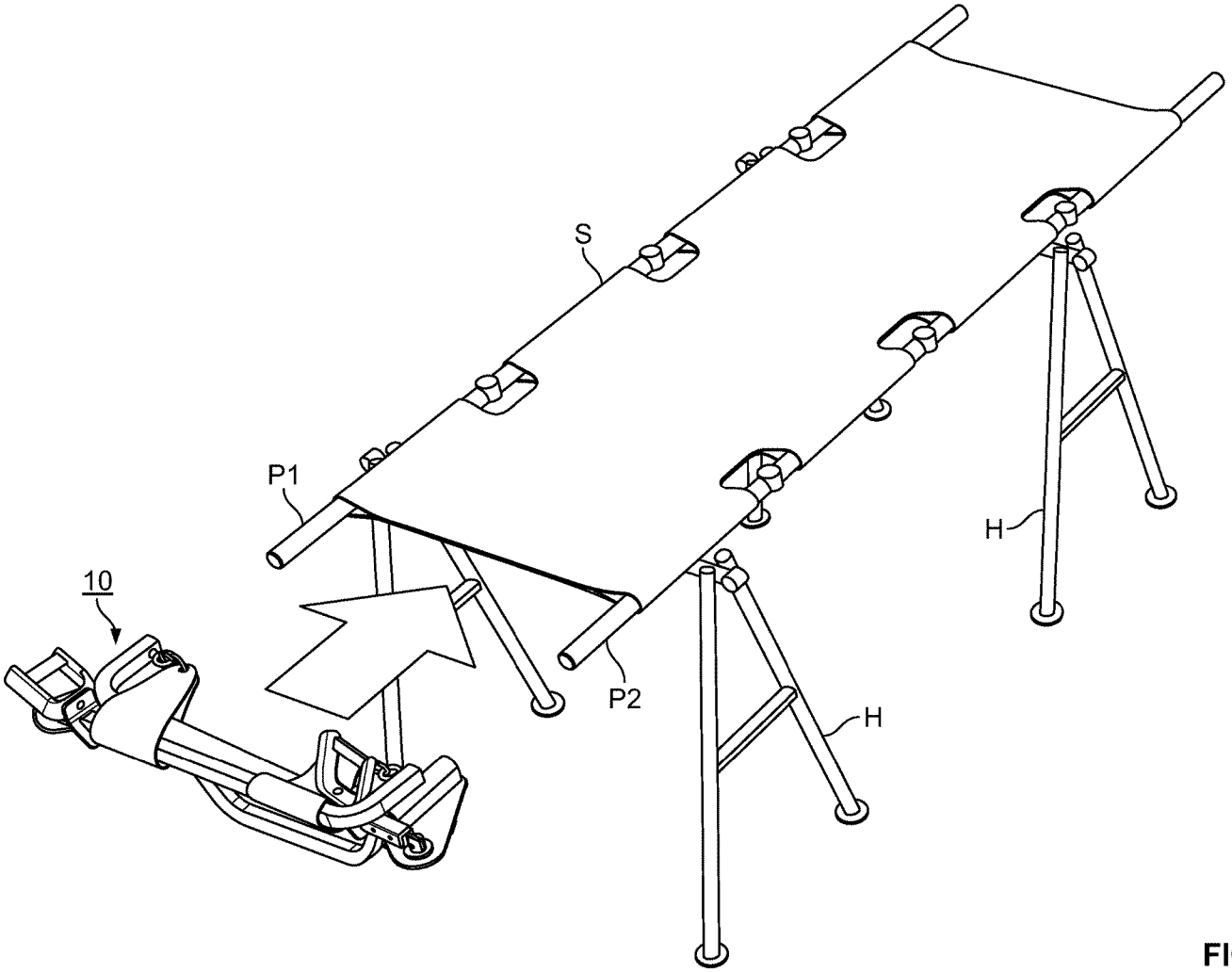
FIG. 1 is a perspective view of a closed (folded) foot support and stirrups assembly constructed in accordance with an embodiment of the present invention, shown in the process of being attached to a stretcher.
Figure 2:
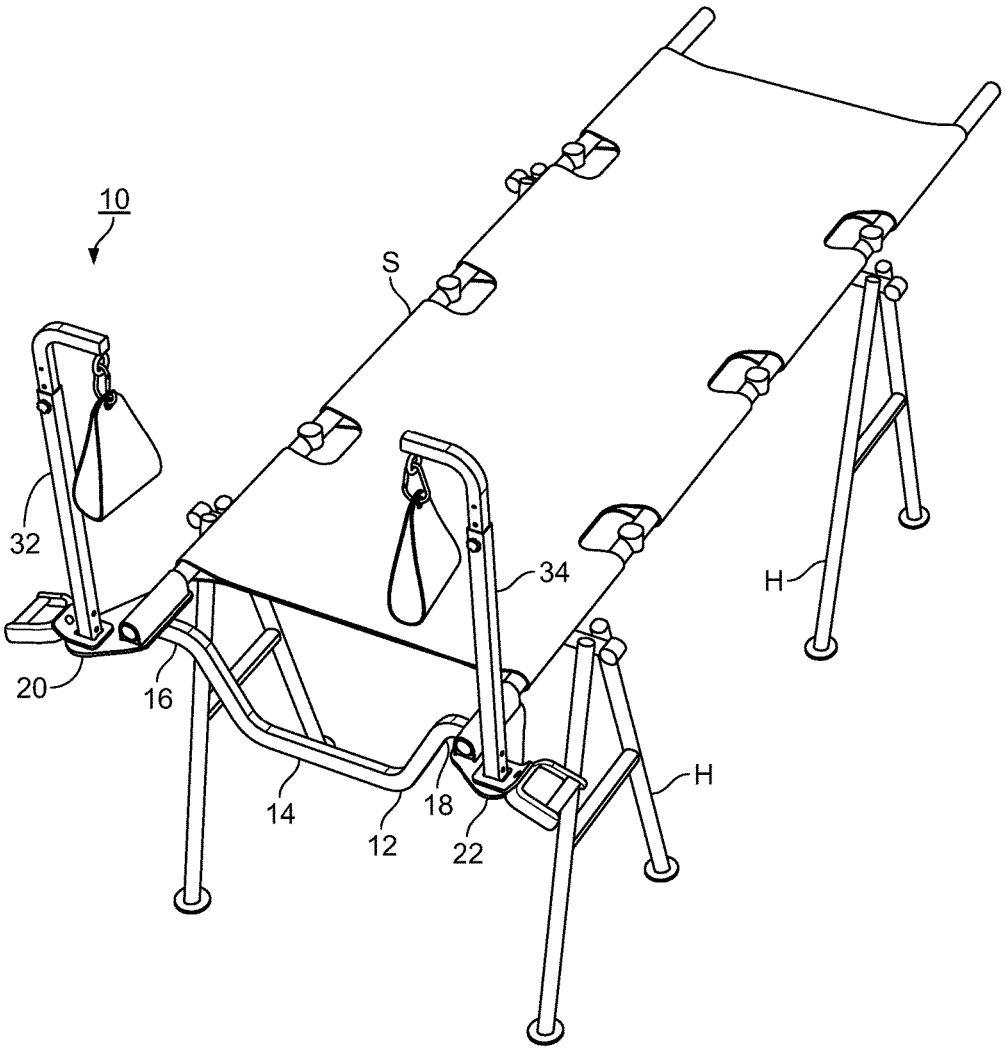
FIG. 2 is a perspective view of the foot support and stirrups assembly of FIG. 1, shown in the vertical open (unfolded) position and attached to the stretcher.
Figure 3:
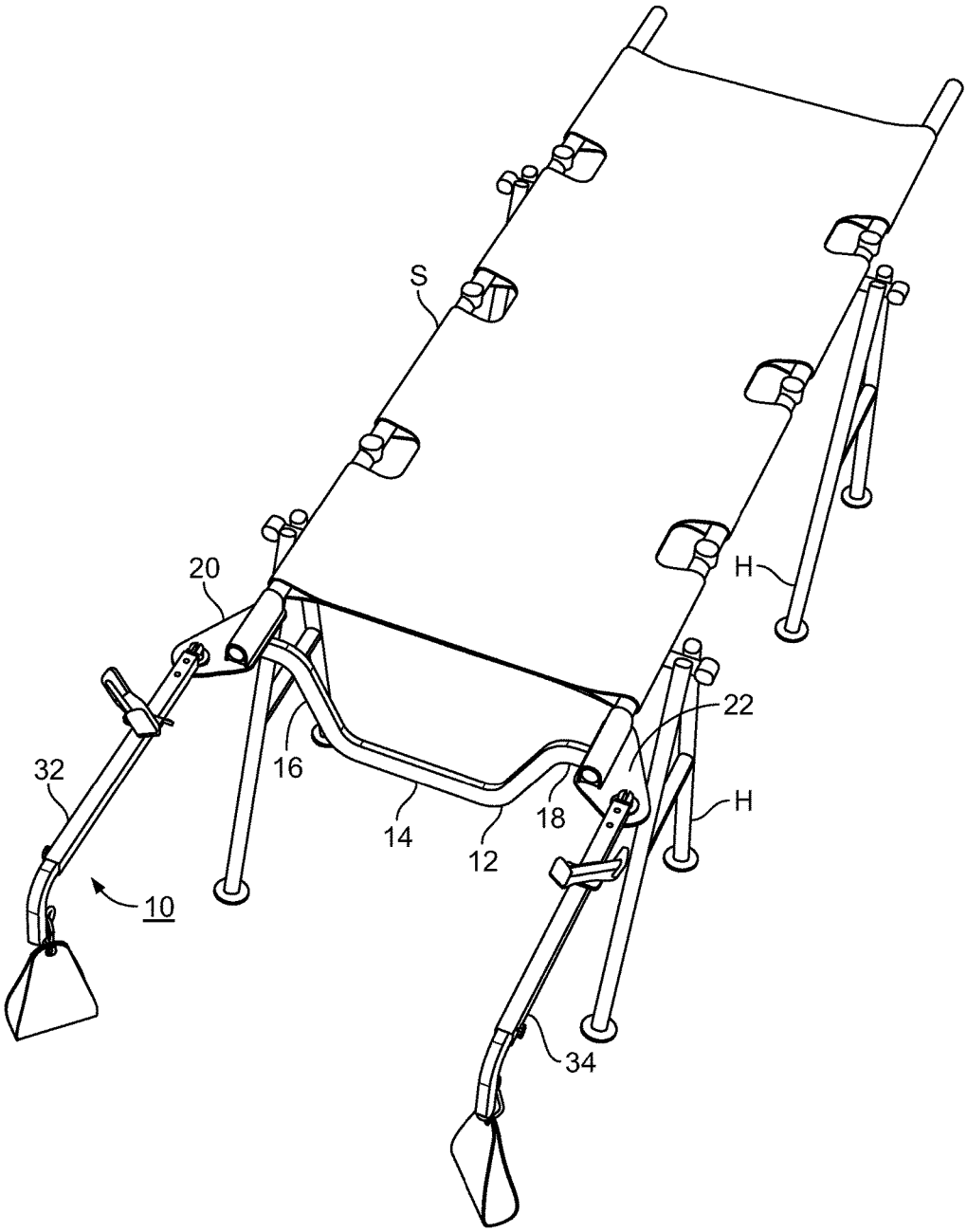
FIG. 3 is a perspective view of the foot support and stirrups assembly of FIG. 1, shown in the horizontal open (unfolded) position and attached to a stretcher.

FIGS. 1-13 illustrate a foot and leg support and stirrups assembly device 10 (hereinafter "device 10" for brevity) constructed in accordance with an embodiment of the present invention. More particularly, as shown in FIG. 1, the device 10 is removably attachable to a stretcher S. The stretcher S may include a collapsible bed or mat made of fabric such as canvas that is attached to poles P1, P2. As indicated in FIGS. 1-3, the stretcher S may be supported on horses H or maneuvered by hand (i.e., by grasping the poles P1, P2).

Referring to FIGS. 2 to 13, which show the device 10 in various orientations and as viewed from various angles, the device 10 includes a U-shaped transverse member 12 that has a transverse rod 14 with first and second ends 16, 18. The first and second ends 16, 18 are offset from the rod 14 and have the same axial orientation as the rod 14. Attached to the first and second ends 16, 18 are first and second anchor members 20, 22. The anchor members 20, 22 are plate-like connectors that each support a bracket 24, 26 and a pivotable hinge 28, 30 affixed thereto (see FIGS. 4, 8).

Figure 8:
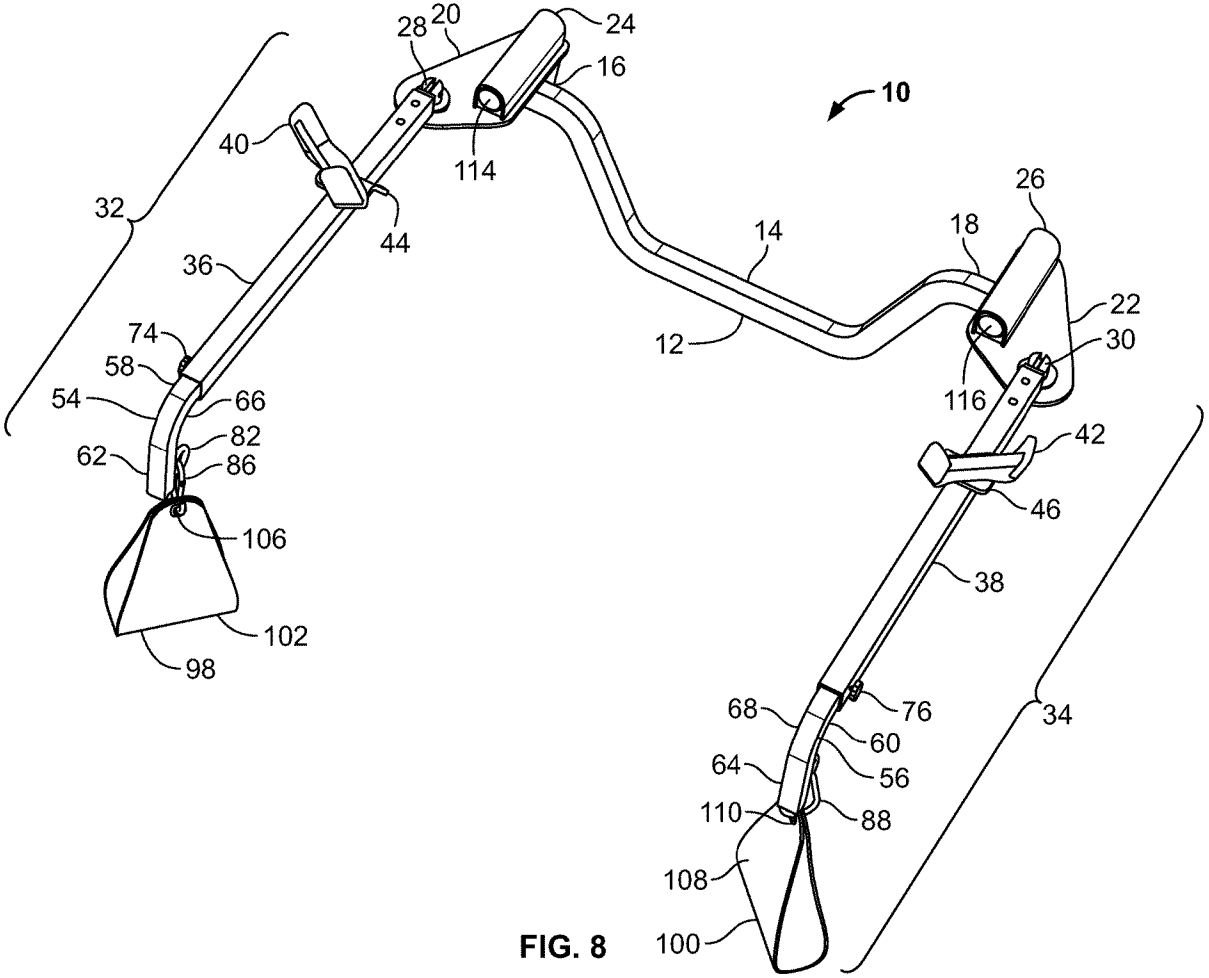
FIG. 8 is a perspective view of the foot support and stirrups assembly of FIG. 1, shown in the horizontal open (unfolded) position.
Figure 9:
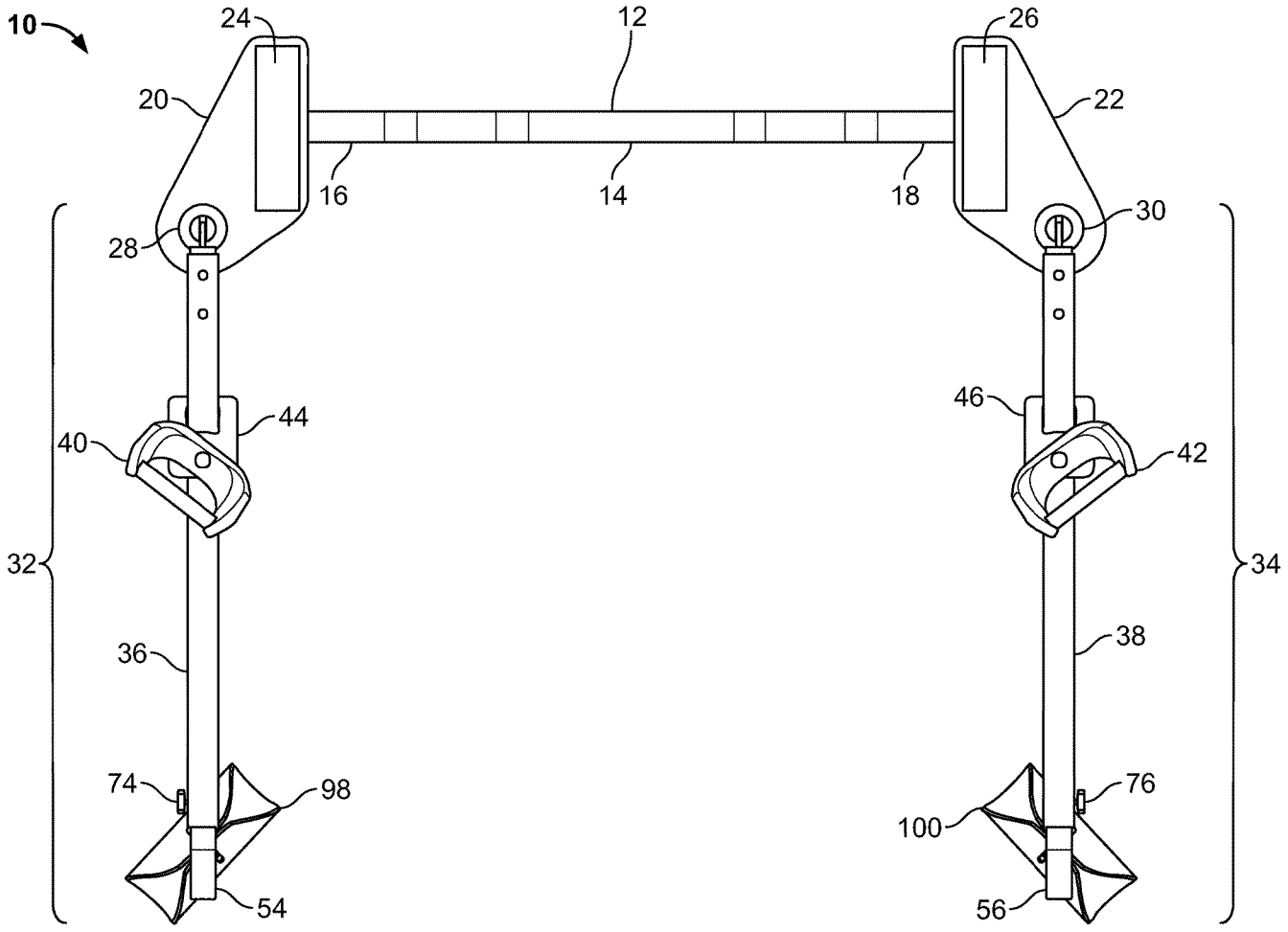
FIG. 9 is top view of the foot support and stirrups assembly of FIG. 1, shown in the horizontal open (unfolded) position.
Figure 10:
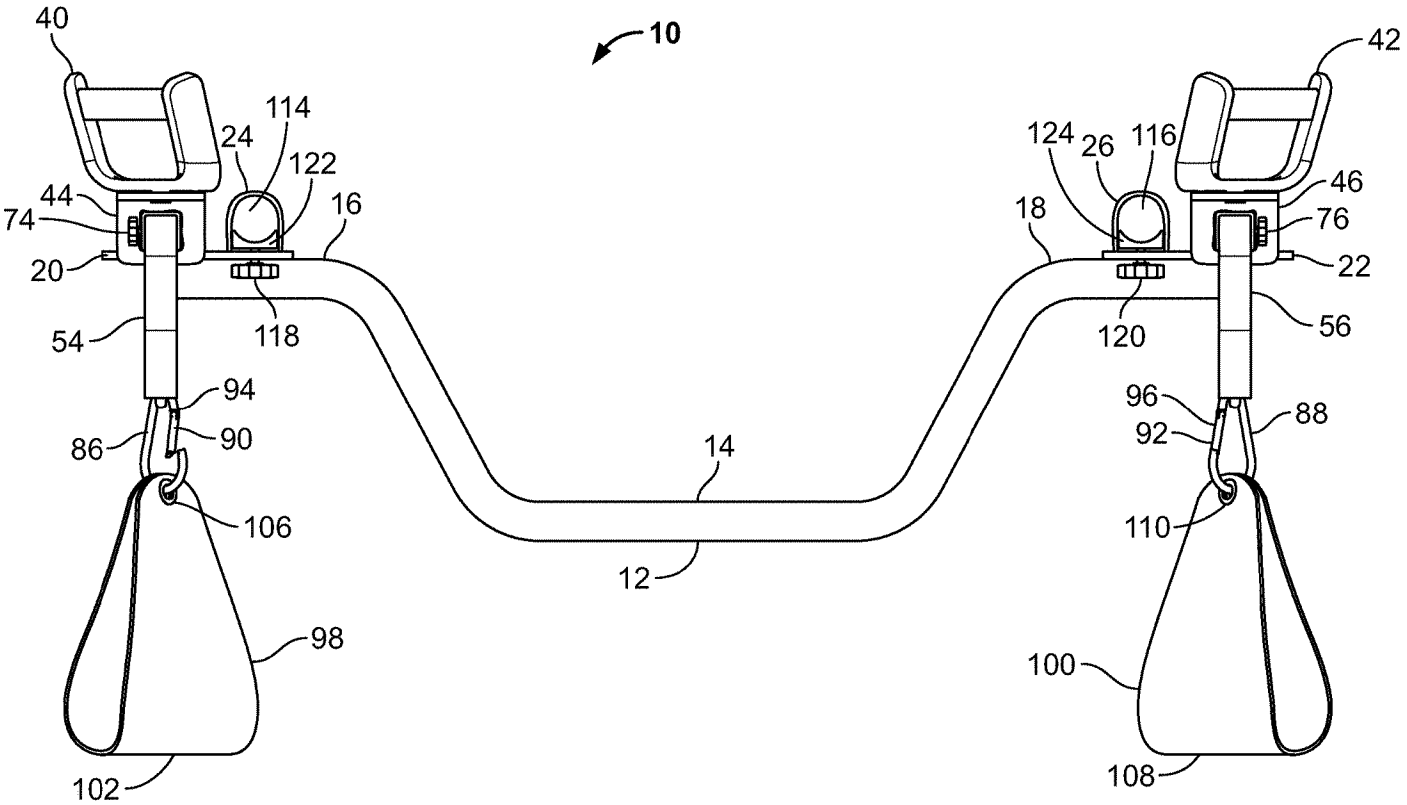
FIG. 10 is a front view of the foot support and stirrups assembly shown in FIG. 8 in the horizontal open (unfolded) position.
Figure 11:
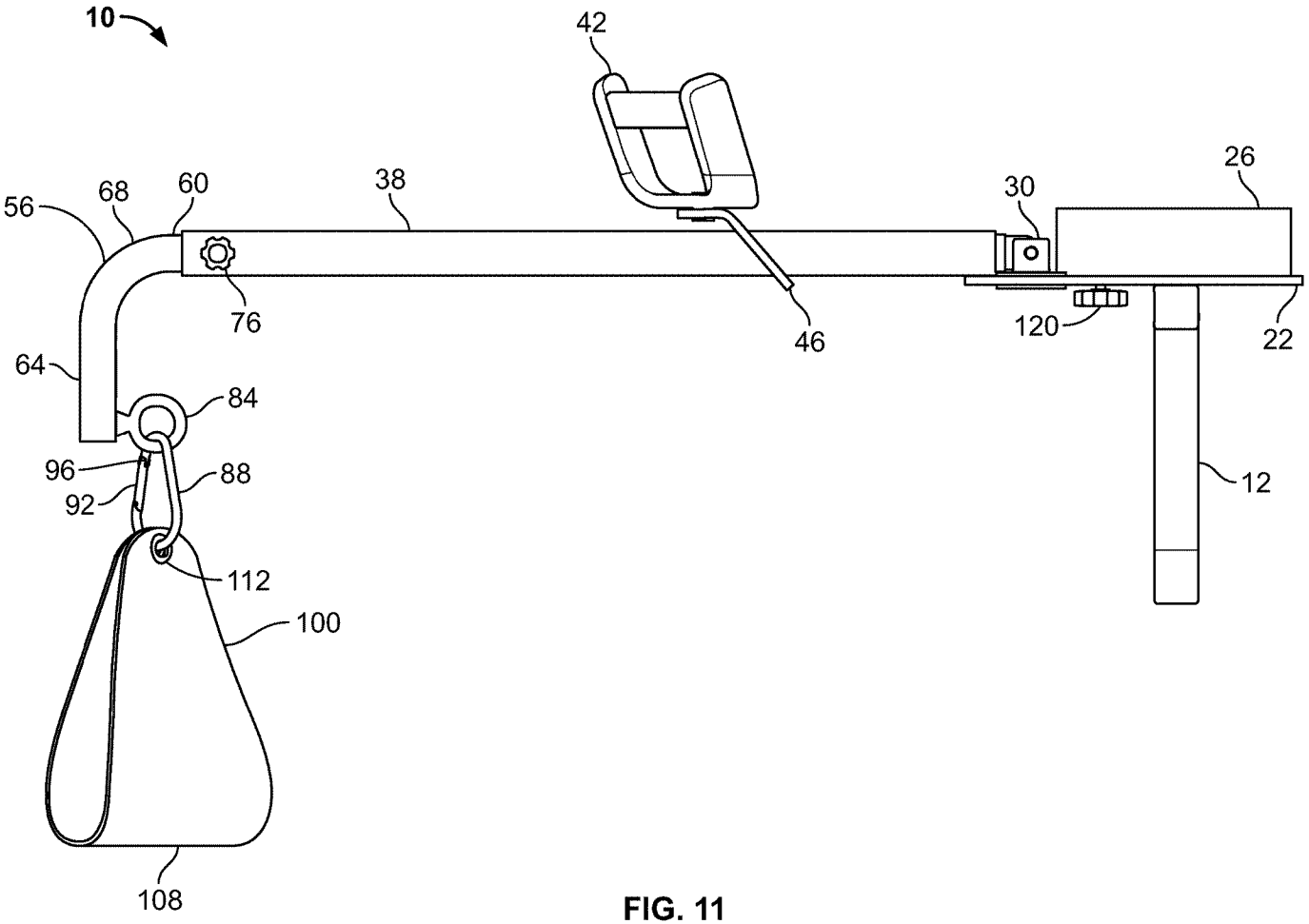
FIG. 11 is a right side view of the foot support and stirrups assembly shown in FIG. 8 in the horizontal open (unfolded) position.
Figure 12:
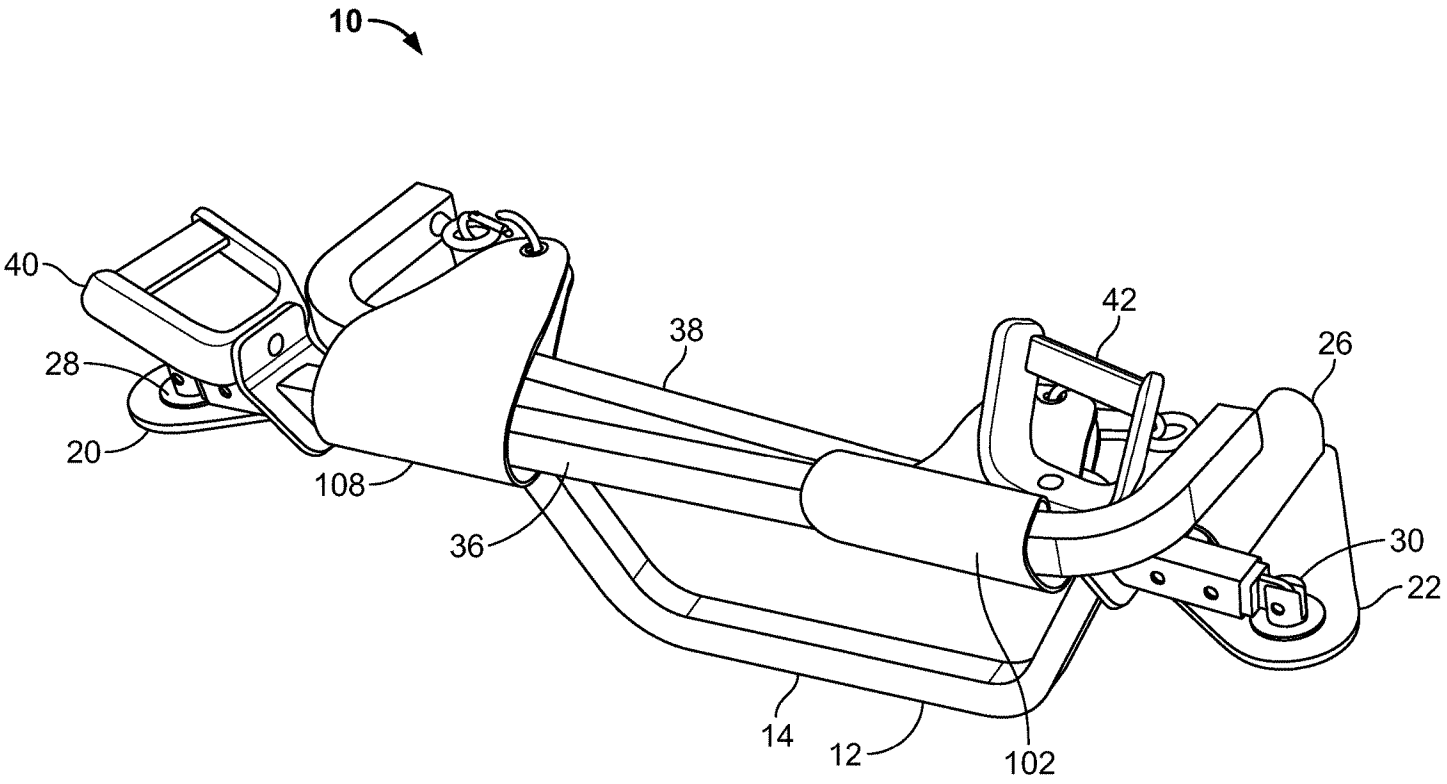
FIG. 12 is a top perspective view of the closed (folded) foot support and stirrups assembly shown in FIG. 1 in the closed (folded) position.
Figure 13:
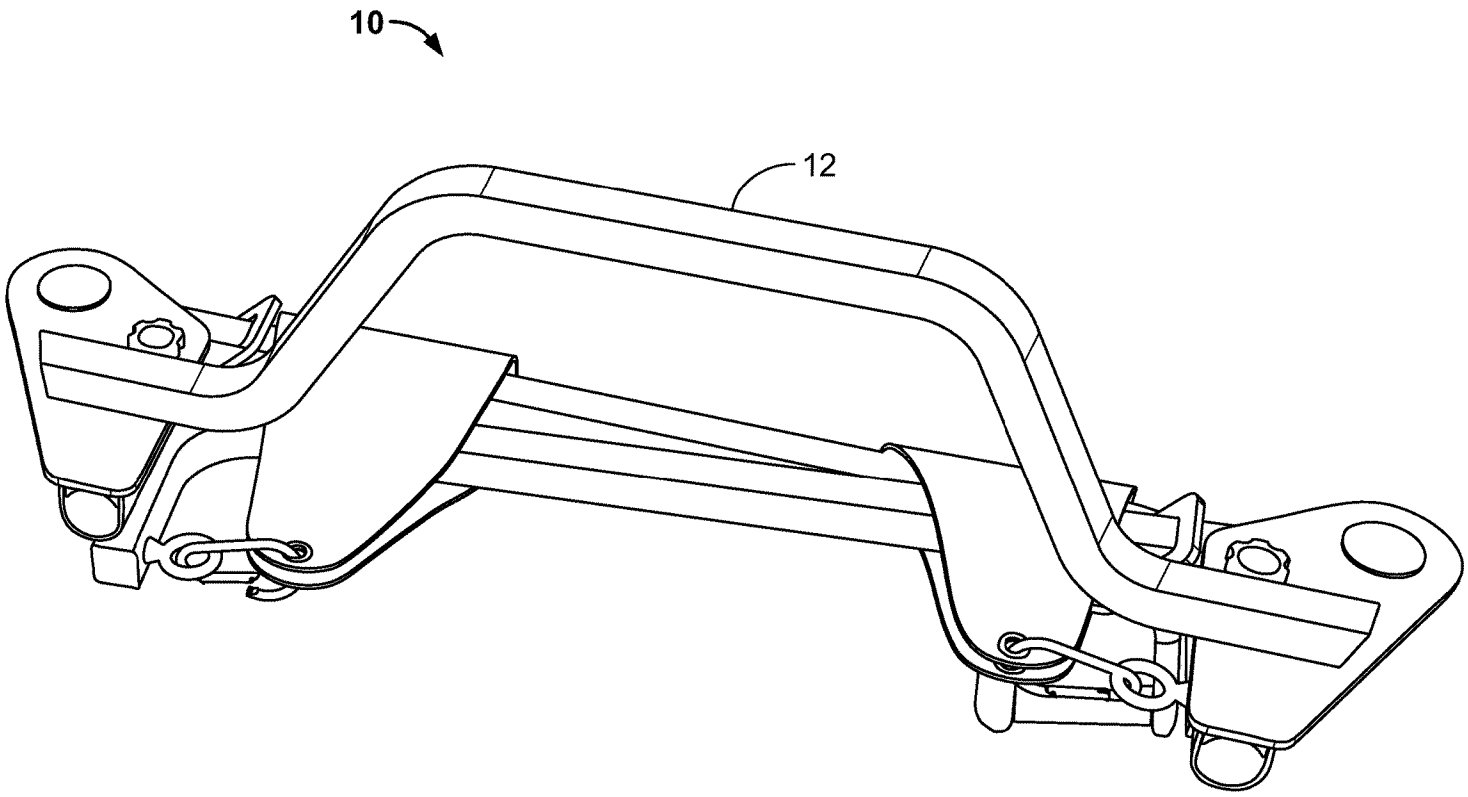
FIG. 13 is a bottom perspective view of the closed (folded) foot support and stirrups assembly shown in FIG. 1 in the closed (folded) position.

Each pivotable hinge 28, 30 connects the corresponding anchor member 20, 22, to a stirrups assembly 32, 34 (see FIG. 8). The pivotable hinges 28, 30 provide a pivotable connection such that the corresponding stirrups assemblies 32, 34 can be placed in a vertical open position as shown in FIGS. 2 and 4, a horizontal open position as shown in FIG. 3, or a closed position as shown in FIGS. 12 and 13.

Figure 4:
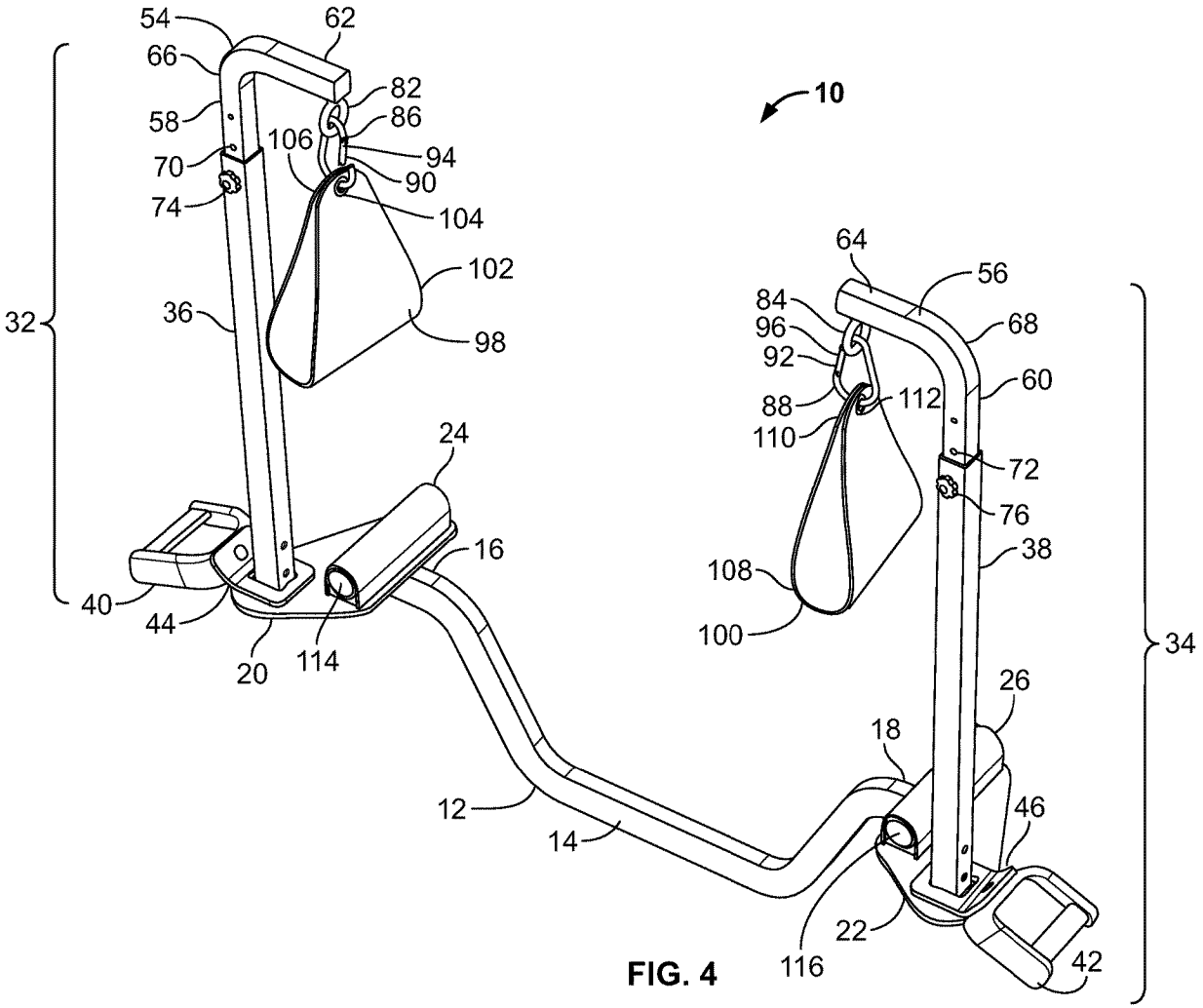
FIG. 4 is a perspective view of the foot support and stirrups assembly of FIG. 1, shown in the vertical open (unfolded) position.
Figure 5:
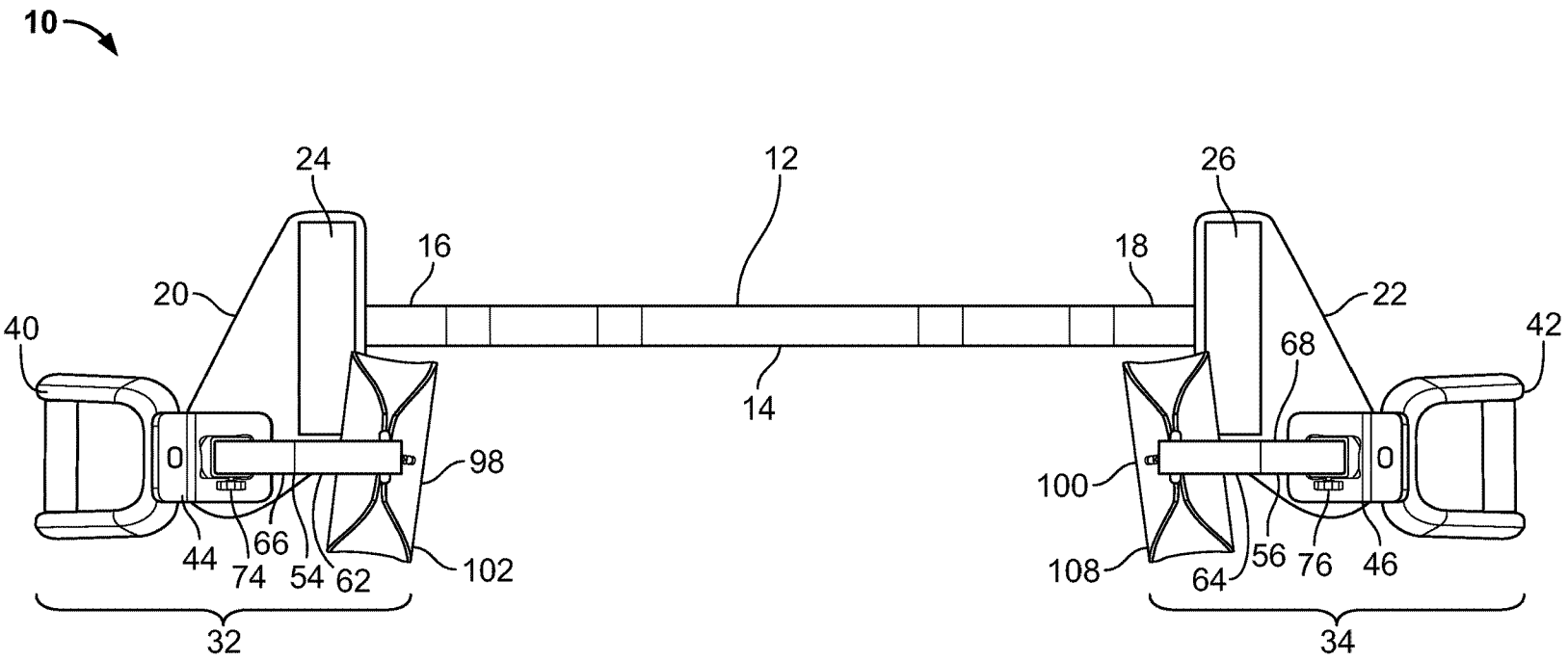
FIG. 5 is a top plan view of the foot support and stirrups assembly shown in FIG. 4.
Figure 6:
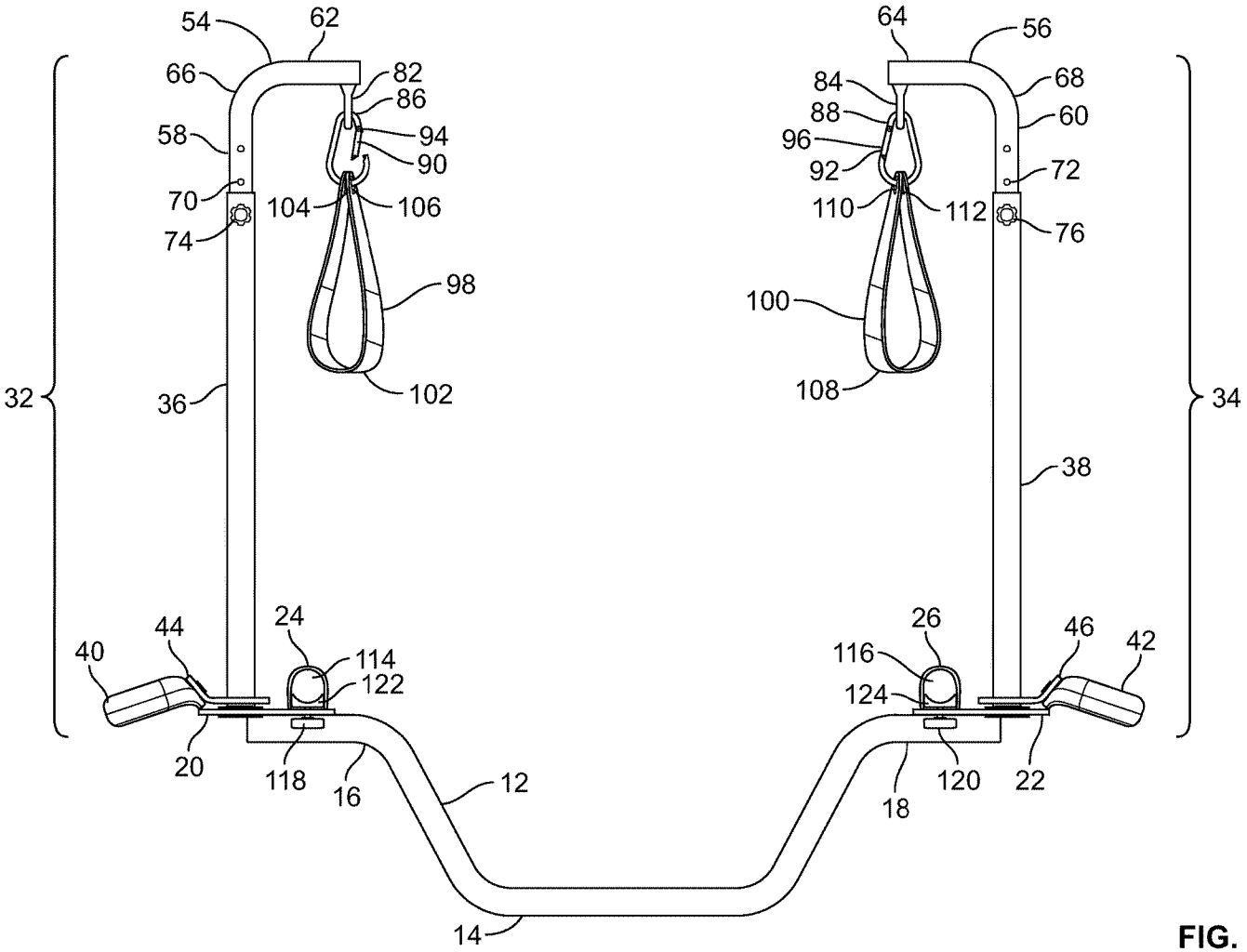
FIG. 6 is a front view of the foot support and stirrups assembly shown in FIG. 4.
Figure 7:
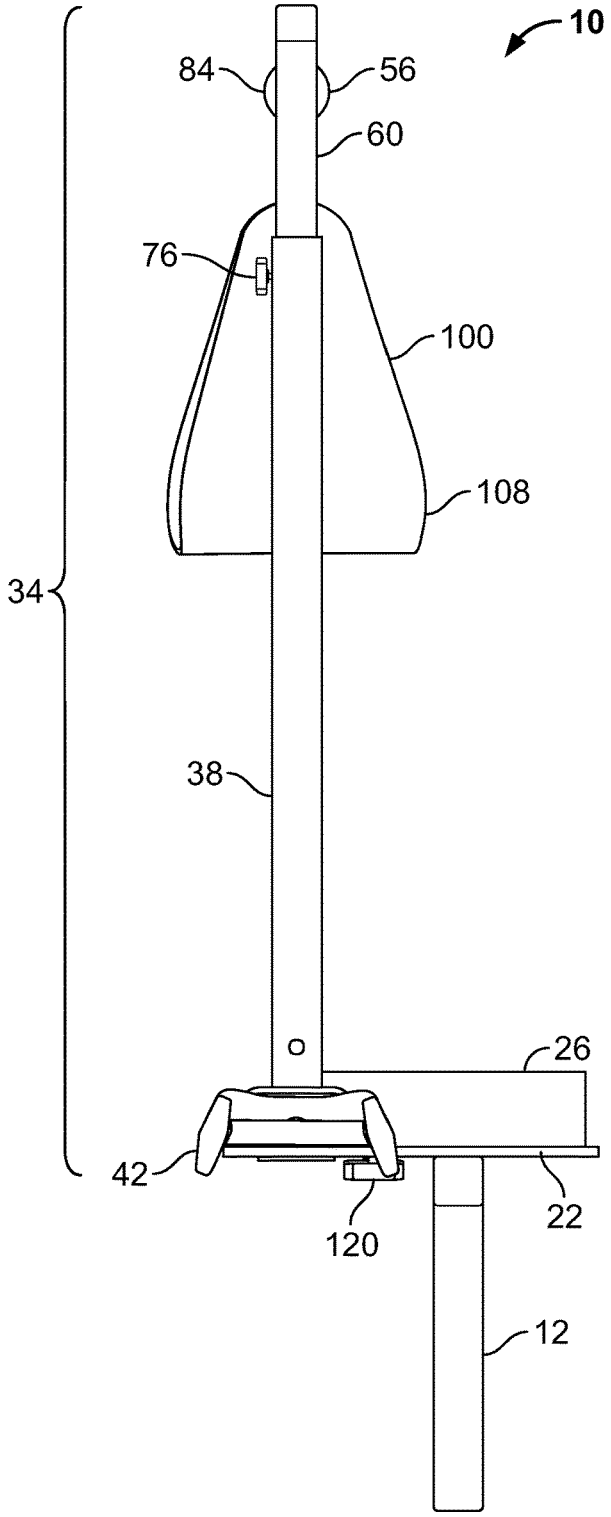
FIG. 7 is a right side view of the support and stirrups assembly shown in FIG. 4.

Each stirrups assembly 32, 34 includes a stanchion 36, 38 connected to the corresponding pivotable hinge 28, 30 (see FIGS. 4, 8). The stirrups assemblies 32, 34 include rigid foot stirrups 40, 42 slidably positioned along corresponding stanchions 36, 38. Each rigid foot stirrup 40, 42 includes a mounting bracket 44, 46 (see FIGS. 4-6).

Figure 14:
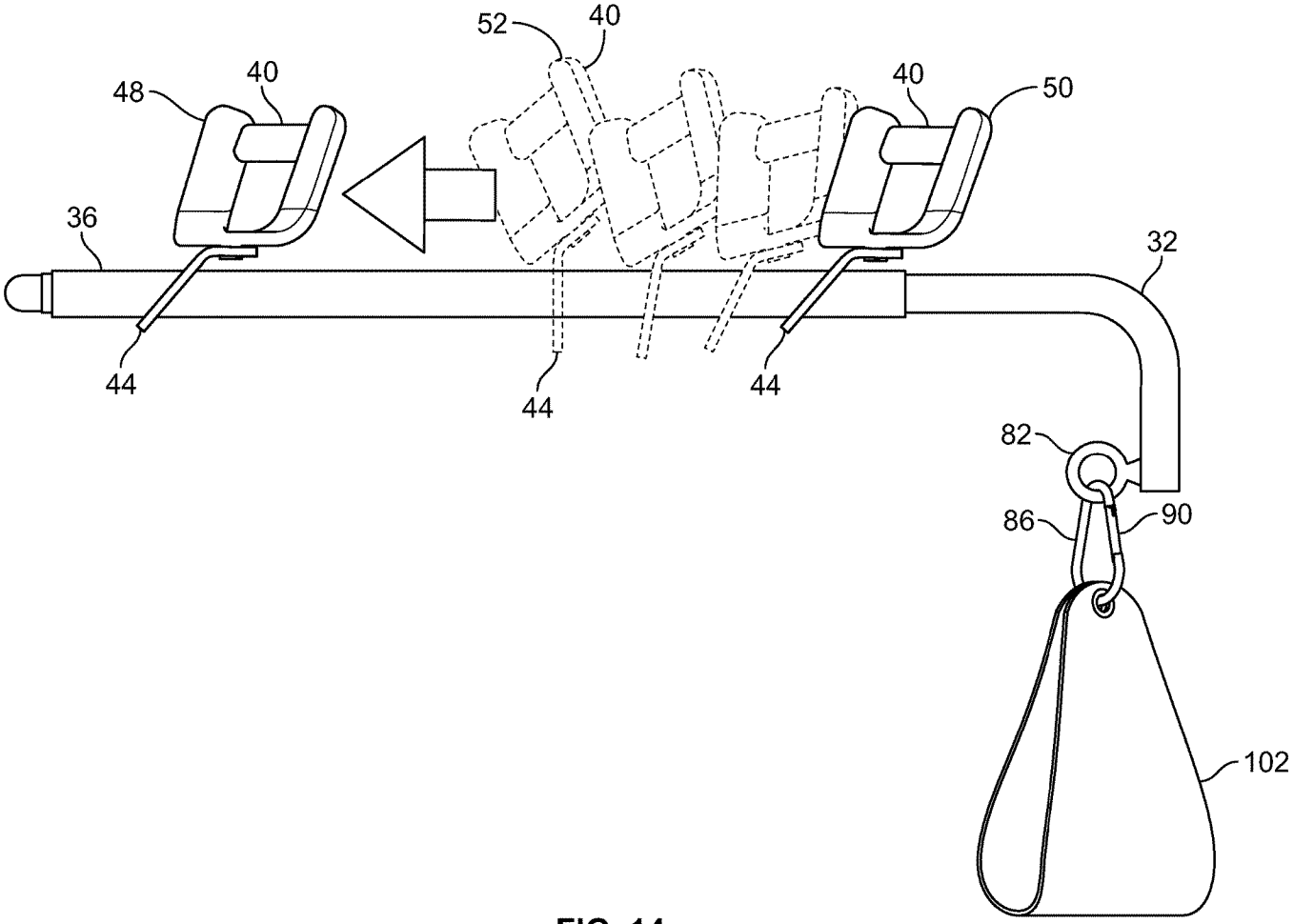
FIG. 14 is a side view of the foot support and stirrups assembly shown in FIG. 8 in the horizontal open (unfolded) position, the stirrup being shown in various positions along the stanchion.

Referring now to FIG. 14, the stirrups assembly 32 (or 34) is shown in the horizontal open position previously described with reference to FIG. 3. FIG. 14 will be discussed with reference to the stirrups assembly 32; it will be apparent to those of skill in the art that the discussion of FIG. 14 is equally applicable to the stirrups assembly 34. The mounting bracket 44 is sized, shaped, and oriented such that, when at rest, the weight of the rigid foot stirrup 40 and the weight of the patient's foot resting therein causes friction between the mounting bracket 44 and the stanchion 36, preventing the rigid foot stirrup 40 from sliding along the stanchion 36 and retaining the rigid foot stirrup 40 in a first position 48, a second position 50, or another desired position along stanchion 36. Conversely, when the rigid foot stirrup 40 is lifted into an upright position 52 (shown in phantom), the frictional engagement between the mounting bracket 44 and the stanchion 36 is relieved and the rigid foot stirrup 40 may be slid along the stanchion 36.

Referring back to FIG. 4, each stirrups assembly 32, 34 includes a telescoping stirrup support 54, 56 of the type that is known in the art as "candy cane" stirrups. Each telescoping stirrup support 54, 56 includes a first portion 58, 60 that is slidably engaged with the corresponding stanchion 36, 38, a second portion 62, 64 oriented substantially perpendicular to the first portion 58, 60, and a curved portion 66, 68 between the first portion 58, 60 and the second portion 62, 64, respectively. The first portion 58, 60 includes two or more holes 70, 72, respectively. The stanchion 36, 38 includes an arm adjustment pin 74, 76, respectively.

Figure 15:
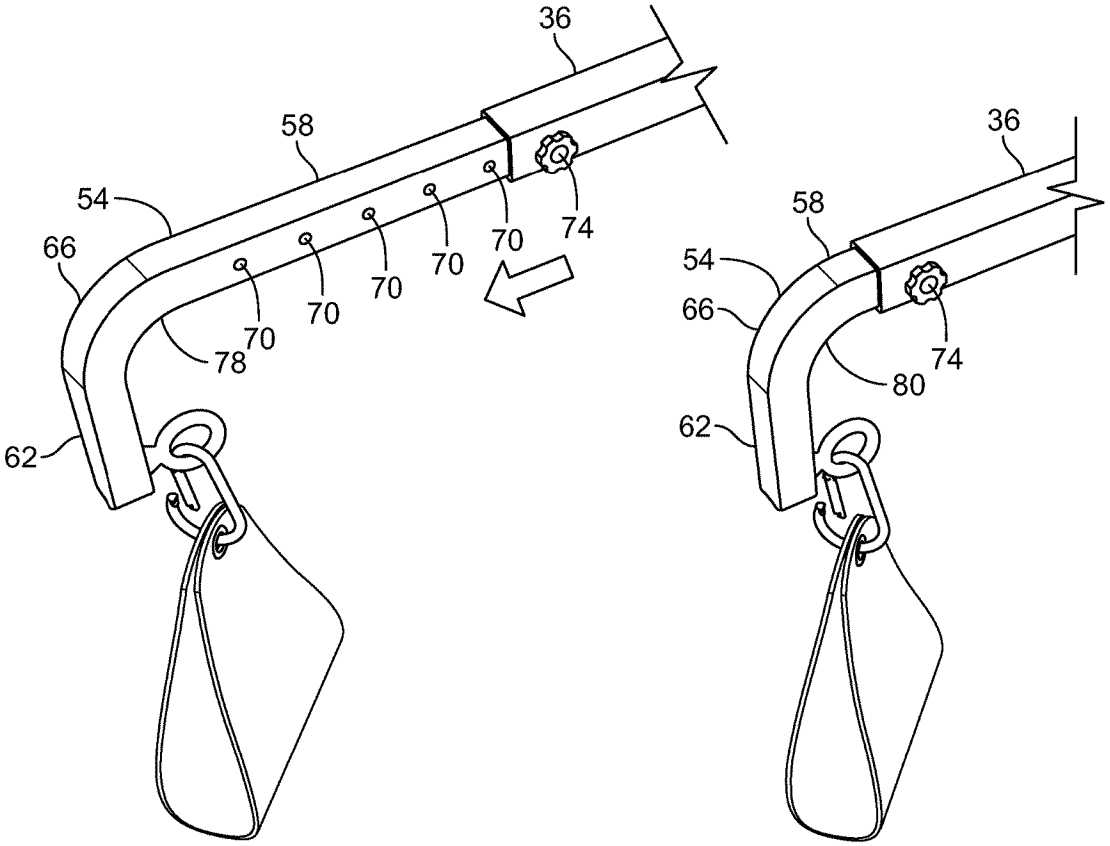
FIG. 15 is a perspective view of a telescoping arm of the foot support and stirrups assembly shown in FIG. 3, shown both extended out of a stanchion of the foot support and stirrups assembly and retracted into the stanchion.

Referring now to FIG. 15, the stirrups assembly 32 (or 34) is shown. FIG. 15 will be discussed with reference to the stirrups assembly 32; it will be apparent to those of skill in the art that the discussion of FIG. 15 is equally applicable to the stirrups assembly 34. The arm adjustment pin 74 can be selectively engaged with a desired one of the holes 70 to adjust the length of the protruding portion of the first portion 58 of the telescoping stirrup support 54 that protrudes from the stanchion 36. Adjustment options may include a first (e.g., extended) position 78, a second (e.g., retracted) position 80, or other positions intermediate between the first and second positions 78, 80. Adjustment of the length of the protruding portion provides a corresponding adjustment to the height of the second portion 62 of the telescoping stirrup support 54 when the stirrups assembly 32 is in the vertical open position shown in FIGS. 2 and 4. In an embodiment, each of the first portions 58, 60, includes ten holes 70, 72. In an embodiment, the holes 70, 72 are spaced at regular intervals 1.25 inches apart. It will be apparent to those of skill in the art that the specific quantity and spacing of the holes 70, 72 described above are only exemplary and that variations are possible without departing from the broader concepts of the exemplary embodiments.

Referring again to FIG. 4, each stirrups assembly 32, 34 includes an eye 82, 84 connected to the second portion 62, 64 of the telescoping stirrup support 54, 56 and positioned such that the eye 82, 84 is below the second portion 62, 64 when the stirrups assembly 32, 34 is in the vertical open position shown in FIGS. 2 and 4. Each eye 82, 84 is connected to a chain link 86, 88. Each chain link 86, 88 includes a chain link pin 90, 92 connected to chain link 86, 88 by a hinge 94, 96. The hinge 94, 96 is biased to retain the chain link pin 90, 92 in a closed position, but a force can be applied to the chain link pin 90, 92 to move the chain link pin 90, 92 in an open position and thereby allow an object to be threaded onto the chain link 86, 88. In FIG. 4 and throughout the drawings, for illustrative purposes, the chain link pin 90 of the chain link 86 is shown in an open position, while the chain link pin 92 of the chain link 88 is shown in a closed position; it will be apparent to those of skill in the art that both of the chain link pins 90, 92 can be selectively moved between the open and closed positions as described above.

Continuing to refer to FIG. 4, each stirrups assembly 32, 34 also includes a soft stirrup 98, 100. The soft stirrup 98 comprises a strap 102 with eyelets 104, 106 at either end; the soft stirrup 100 comprises a strap 108 with eyelets 110, 112 at either end. The straps 102, 108 are sized and shaped to support a patient's foot when hung by the eyelets 104, 106, 110, 112, and are made of cloth having sufficient flexibility and durability for the same purpose, such as canvas. The soft stirrups 98, 100 are threaded onto the chain links 82, 84 and can be removed by applying a force to the chain link pins 90, 92, to move the chain link pins 90, 92 into an open position as described above. When the stirrups assemblies 32, 34 are in the vertical open position, as shown in FIGS. 2 and 4, the soft stirrups 98, 100 hang from the eyes 82, 84, and thereby from the second portions 62, 64 of the telescoping stirrup supports 54, 56, in a position such that they may support the feet of a patient who is recumbent on the stretcher S.

Figure 16:
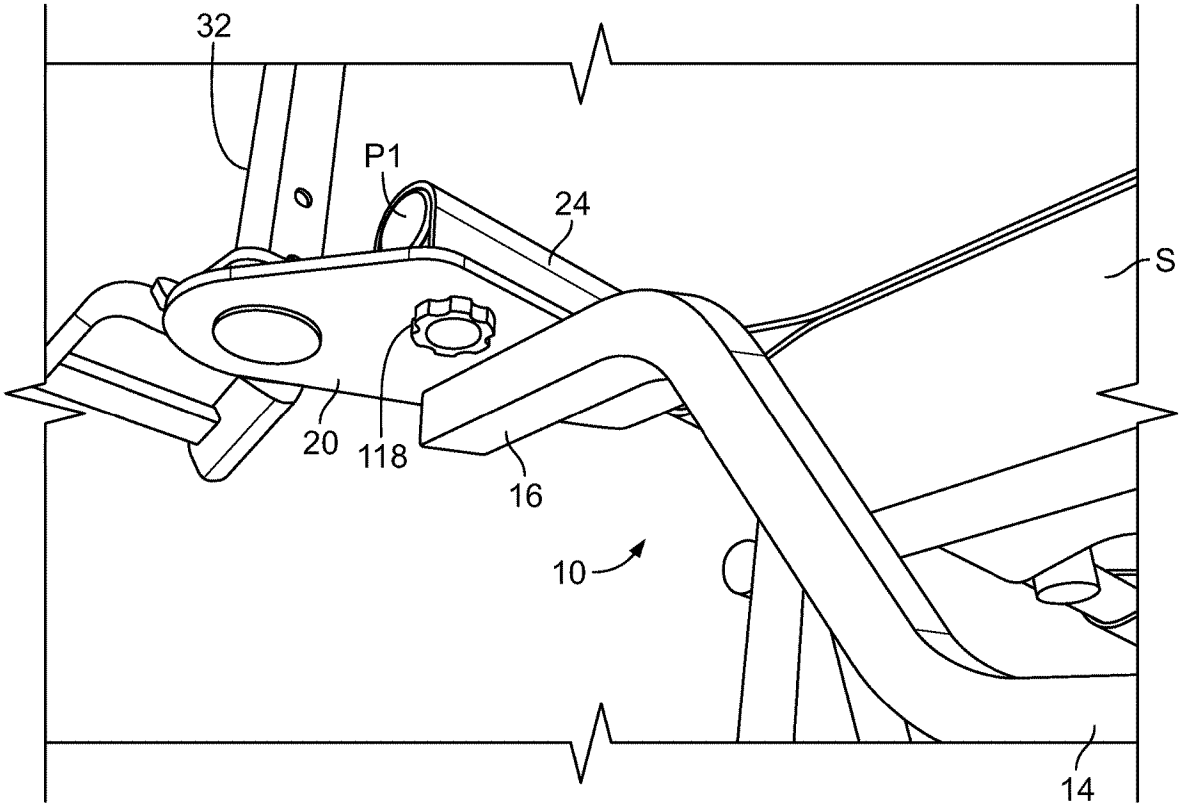
FIG. 16 is a bottom view of a locking screw inserted through an anchor plate of the foot support and stirrups assembly shown in FIG. 1 so as to lock a stretcher pole in a bracket of the foot support and stirrups assembly.

As described above, the device 10 can be removably attached to the stretcher S, which includes the poles P1 and P2. Referring now to FIG. 16, the manner of attachment of the device 10 to the stretcher S is shown; the depiction of FIG. 16 is limited to one side of the device 10, but the elements depicted therein will be described with reference to both the first and second sides thereof. The first and second anchor members 20, 22 are attached to the first and second ends 16, 18, respectively, of the U-shaped transverse member 12. The first and second anchor members 20, 22 support the brackets 24, 26, respectively. The brackets 24, 26 have bores 114, 116 that are sized and shaped to receive respective ends of the poles P1, P2 of the stretcher S therein. The first and second anchor members 20, 22 also include adjustment knobs 118, 120, which may be threadedly engaged or disengaged with the first and second anchor members 20, 22 (e.g., through threaded holes formed within the first and second anchor members 20, 22). The adjustment knobs 118, 120 are sized, shaped, and located such that engagement thereof with the first and second anchor members 20, 22, secures the poles P1, P2 within the bores 114, 116, thereby securely attaching the device 10 to the stretcher S. Correspondingly, disengagement of the adjustment knobs 118, 120 from the first and second anchor members 20, 22 enables the poles P1, P2 to be removed from the bores 114, 116, and thereby enables the device 10 to be removed from the stretcher S.

Figure 17:
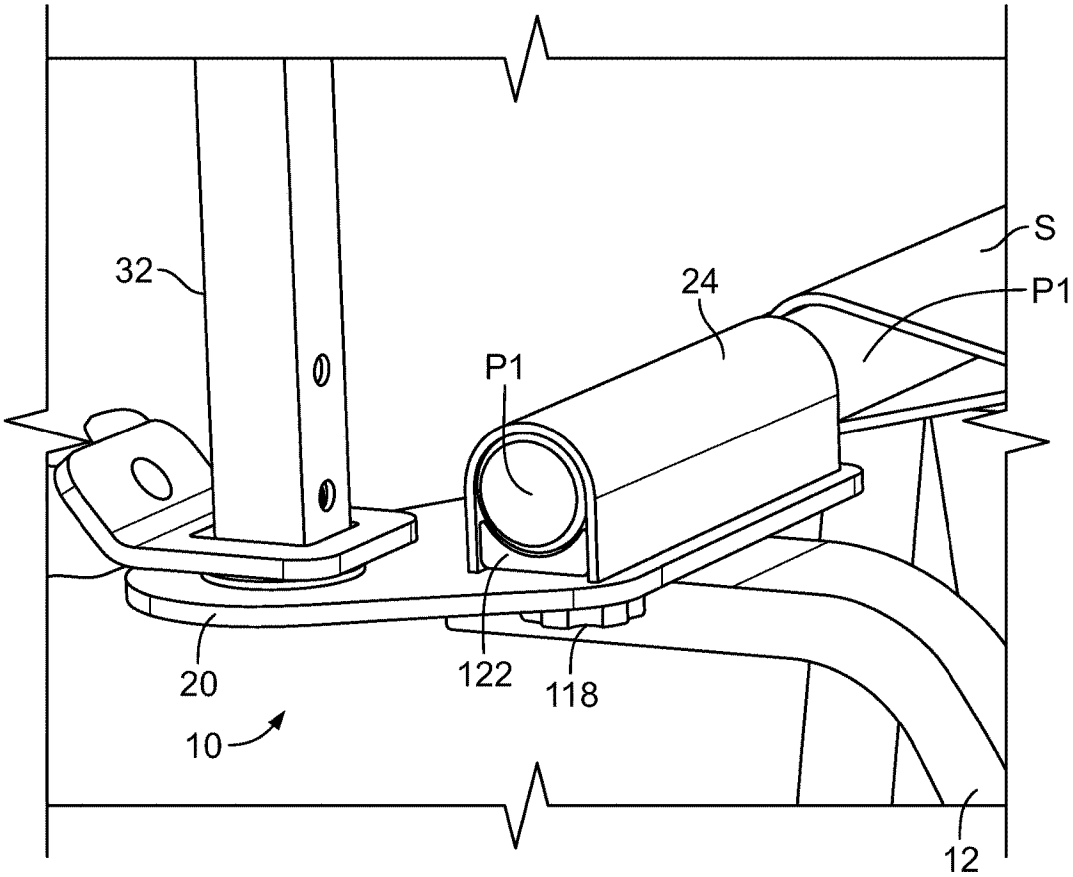
FIG. 17 is a detailed view of the pole inserted in the bracket of FIG. 16, the bracket having a barrier installed in a bore therethrough to protect the pole.

Referring now to FIG. 17, the brackets 24, 26 also enclose barriers 122, 124 positioned between the first and second anchor members 20, 22, and the corresponding poles P1, P2. The barriers 122, 124 are sized and shaped to protect the poles P1, P2, while facilitating the retention thereof within the brackets 24, 26. In an embodiment, the barriers 122, 124 are made of nylon. In an embodiment, the barriers 122, 124 have a curvature complementary to the outside diameter of the poles P1, P2, which may commonly be 1.25 inches. In an embodiment, adjustable positioning of the barriers 122, 124 may enable the device 10 also to be attached to a stretcher S having poles P1, P2 with outside diameters of 1.5 inches. In an embodiment, threaded engagement of the adjustment knobs 118, 120 with the first and second anchor members 20, 22 forces the barriers 122, 124 toward the poles P1, P2, thereby securing the poles P1, P2 between the brackets 24, 26 and the barriers 122, 124.

As described above, the pivotable hinges 28, 30 can be operated such that the corresponding stirrups assemblies 32, 34 are placed in a closed position. Referring now to FIG. 12, a closed position is shown. The pivotable hinges 28, 30 have been placed in a position such that the stanchions 36, 38 are substantially parallel to the rod 14 of the transverse member 12. In an embodiment, the straps 102, 108 can be removed from the corresponding chain links 86, 88 at either end, looped around both stanchions 36, 38, and re-attached to the corresponding chain links 86, 88 so as to retain the stanchions 36, 38, and thereby the device 10, in a closed position. Referring now to FIG. 13, after being placed in a closed position, the device 10 may be inverted and the rod 14 of the transverse member 12 can be used as a carrying handle for transportation of the device 10.

It should be understood that the embodiments described herein are merely exemplary in nature and that a person skilled in the art may make many variations and modifications thereto without departing from the scope of the present invention. All such variations and modifications, including those discussed above, are intended to be included within the scope of the invention.

We claim:

1. A device for facilitating a medical examination, comprising:

a transverse member having a first end, a second end opposite said first end, and a horizontal axis extending from said first end to said second end;

first and second connectors fastened to corresponding ones of said first and second ends of said transverse member, each of said first and second connectors having a bracket and a hinge affixed thereto; and first and second stirrups assemblies pivotally attached to corresponding first and second ones of said hinges, each of said stirrups assemblies having:

a stanchion having a first end, a second end opposite said first end, and a longitudinal axis extending from said first end of said stanchion to said second end of said stanchion, said first end of said stanchion being pivotally affixed to said hinge such that said longitudinal axis of said stanchion can be selectively oriented in (i) a first orientation substantially parallel to said horizontal axis of said transverse member, (ii) a second orientation along a vertical axis substantially perpendicular to said horizontal axis of said transverse member, and (iii) a third orientation along a normal axis substantially perpendicular to said horizontal axis of said transverse member and substantially perpendicular to said vertical axis, a stirrup support having a first portion that is substantially parallel to said longitudinal axis of said stanchion and a second portion that is substantially perpendicular to said longitudinal axis of said stanchion, one end of said first portion of said stirrup support being mounted in said second end of said stanchion such that said first portion is telescopically extensible from said second end of said stanchion along said longitudinal axis of said stanchion, and an opposite end of said first portion of said stirrup support being attached to said second portion of said stirrup support, a multi-positional foot support stirrup slideably positioned along said stanchion, and a soft stirrup attached to said second portion of said stirrup support.

2. The device of claim 1, wherein said stirrup support includes a curved portion connecting said first portion to said second portion.

3. The device of claim 2, wherein said stirrup support includes an eye fixed to said second portion.

4. The device of claim 3, wherein said stirrup support includes a chain link removably engaged with said eye, and wherein said soft stirrup is removably engaged with said chain link.

5. The device of claim 1, wherein said stirrups assembly further comprises means for securing said stirrup support at a desired extension from said second end of said stanchion.

6. The device of claim 5, wherein said means for securing said stirrup support includes a pin adjacent said second end of said stanchion and a plurality of holes within said stirrup support, each of said holes being adapted to selectively receive said pin.

7. The device of claim 6, wherein said plurality of holes includes ten holes.

8. The device of claim 1, wherein said multi-positional foot support stirrup includes a mounting bracket.

9. The device of claim 8, wherein said mounting bracket is operable to retain said multi-positional foot support stirrup in a position along said stanchion.

10. The device of claim 1, in combination with a stretcher having a first pole and a second pole, wherein said bracket of said first connector receives the first pole of the stretcher therein and said bracket of said second connector receives the second pole of the stretcher therein.

11. The device of claim 10, wherein said bracket of said first connector and said bracket of said second connector includes corresponding first and second barriers sized and shaped to be complementary to the first and second poles of the stretcher.

12. The device of claim 11, wherein said barriers include nylon.

13. The device of claim 11, wherein said barriers are sized and shaped to be complementary to an outside diameter of the first and second poles, said outside diameter being in a range between about 1.25 and about 1.5 inches.

14. The device of claim 1, wherein said transverse member is U-shaped.

15. The device of claim 14, wherein said transverse member includes a central portion disposed between said first end of said transverse member and said second end of said transverse member, said central portion of said transverse member having a longitudinal axis that is substantially parallel to said horizontal axis and offset from said horizontal axis.

16. The device of claim 1, wherein each of said connectors includes a plate.

* * * * *